US009370073B2

(12) United States Patent
Pi

(10) Patent No.: US 9,370,073 B2
(45) Date of Patent: Jun. 14, 2016

(54) SOLID-STATE LIGHTING SYSTEMS HAVING INTELLIGENT CONTROLS

(71) Applicant: Axlen, Inc., Wilmington, DE (US)

(72) Inventor: Bo Pi, Carlsbad, CA (US)

(73) Assignee: AXLEN, INC., Wilmington, DE (US)

( * ) Notice: Subject to any disclaimer, the term of this patent is extended or adjusted under 35 U.S.C. 154(b) by 225 days.

(21) Appl. No.: 13/865,132

(22) Filed: Apr. 17, 2013

(65) Prior Publication Data

US 2013/0270998 A1 Oct. 17, 2013

Related U.S. Application Data

(60) Provisional application No. 61/625,594, filed on Apr. 17, 2012, provisional application No. 61/694,106, filed on Aug. 28, 2012.

(51) Int. Cl.
*H05B 33/08* (2006.01)

(52) U.S. Cl.
CPC ..... *H05B 33/0863* (2013.01); *H05B 33/0827* (2013.01); *H05B 33/0869* (2013.01)

(58) Field of Classification Search
CPC ..... C02F 1/00; C02F 2201/00; C02F 9/00; F21K 9/00; F21K 99/00; F21S 10/00; F21S 2/00; F21S 4/00; F21S 48/00; F21S 6/00; F21S 8/00; F21S 9/00; F21V 13/00; F21V 14/00; F21V 15/00; F21V 17/00; F21V 19/00; F21V 21/00; G09G 2300/00; G09G 2300/0426; G09G 2300/0809; G09G 2300/0814; G09G 2300/0819; G09G 2300/0828; G09G 2300/0842; G09G 2300/0852; G09G 2300/0861; G09G 2300/0866
USPC ..... 315/51
See application file for complete search history.

(56) References Cited

U.S. PATENT DOCUMENTS

| | | | | |
|---|---|---|---|---|
| 7,135,966 | B2 * | 11/2006 | Becattini | 340/531 |
| 7,405,715 | B2 | 7/2008 | Guzman et al. | |
| 7,777,427 | B2 | 8/2010 | Stalker, III | |
| 8,115,410 | B2 | 2/2012 | Baaijens et al. | |

(Continued)

OTHER PUBLICATIONS

Lee, D. Y., Authorized Officer, Korean Intellectual Property Office, International Search Report and Written Opinion, International Application No. PCT/US2013/037021, Aug. 12, 2013, 16 pages.

*Primary Examiner* — John Poos
*Assistant Examiner* — David Mattison
(74) *Attorney, Agent, or Firm* — Perkins Coie LLP

(57) ABSTRACT

Techniques, systems and devices are described for controlling the adjustment of colors and optical power of output light of solid-state lighting devices for improved lighting performance. In one aspect, a solid-state lighting system includes a lighting device and a control panel, the lighting device including solid-state light emitters, driver circuits, line sensing electronics that receives signal modulation on a power line connecting the lighting device, a digital controller that decodes the signal modulation into a digital command, and a memory that stores the decoded digital command. The control panel sends the digital command to the lighting device via the power line and modulates electrical power to produce the signal modulation that carries the digital command. In some implementations, a visual indicator may be generated when the control panel receives a digital command from a user to acknowledge the receipt of the digital command.

25 Claims, 14 Drawing Sheets

(56) References Cited

U.S. PATENT DOCUMENTS

2010/0013414 A1 1/2010 Johnson, III et al.
2011/0069094 A1* 3/2011 Knapp ..... 345/690
2011/0234121 A1 9/2011 Ding et al.

* cited by examiner

Measurement of light output intensity from each LED color group using a single channel of a light detection system by short, independent pulses by each group Traditional dimmer waveform, from full power to middle, and low power Digital dimmer/control panel control signals on the powerline

SOLID-STATE LIGHTING SYSTEMS HAVING INTELLIGENT CONTROLS

PRIORITY CLAIM

This patent document claims the priorities and benefits of U.S. provisional application No. 61/625,594 entitled "SOLID STATE LIGHTING SYSTEMS HAVING INTELLIGENT CONTROL CIRCUITS FOR SENDING CONTROL COMMANDS VIA POWERLINE", filed on Apr. 17, 2012, and U.S. provisional application No. 61/694,106 entitled "SOLID STATE LIGHTING SYSTEMS HAVING INTELLIGENT CONTROL CIRCUITS WITH VISUAL INDICATION FOR SENDING CONTROL COMMANDS VIA POWERLINE", filed on Aug. 28, 2012. The entire disclosure of both documents is incorporated herein by reference for all purposes.

TECHNICAL FIELD

This patent document relates to systems, devices, and processes for using light-emitting diodes in lighting devices or lighting fixtures having an array of light pixels.

BACKGROUND

Lighting devices can be constructed by using light pixels arranged in an array where each light pixel is controlled to emit light. A light pixel can be produced by using a light-emitting diode or a laser diode.

A light-emitting diode (LED) is a semiconductor light source. An LED includes semiconducting materials doped with impurities to create a p-n junction, in which electrical current can easily flow one directionally from the p-side (anode) to the n-side (cathode), but not in the reverse direction. Charge-carriers (e.g., electrons and holes) flow into the p-n junction from connecting electrodes at each end of the junction having different voltages. For example, when an electron combines with a hole, the electron falls into a lower energy level and can release energy in the form of a photon, e.g., emitting light. This effect is referred to as electroluminescence. The wavelength of the light emitted, and thus the color of the emitted light, depends on the band gap energy of the materials forming the p-n junction. For example, bright blue LEDs are based on the wide band gap semiconductors including GaN (gallium nitride) and InGaN (indium gallium nitride). LED devices can be used to emit white light that are energy-efficient alternative light sources for replacing some conventional light sources such as incandescent light bulbs and florescent lights. For producing white light using LEDs, one technique is to use individual LEDs that emit three primary colors (red, green, and blue) and then mix all the colors to form white light. Another technique is to use a phosphor material to convert monochromatic light from a blue or ultraviolet LED to broad-spectrum white light, e.g., in a similar manner to fluorescent light bulbs.

A laser diode (LD) is an electrically-pumped semiconductor laser light source. In an LD, the active medium is a solid-state semiconductor formed by a p-n junction, e.g., similar to that found in an LED, rather than a gas medium (e.g., in conventional lasing). Laser diodes form a subset of semiconductor p-n junction diodes. For example, a forward electrical bias across the p-n junction of the LD causes the charge carriers to be injected from opposite sides of the p-n junction into the depletion or junction region, e.g., holes are injected from the p-doped component and electrons are injected from the n-doped component of the semiconductor material. As electrons are injected into the diode, the charge carriers combine, some of their excess energy is converted into photons, which interact with more incoming electrons, thereby producing more photons in a self-perpetuating analogous to the process of stimulated emission that occurs in a conventional, gas-based laser. Some examples of conventional LDs include 405 nm InGaN blue-violet laser diodes, e.g., used in Blu-ray Disc and high definition DVD drive technologies, and 785 nm GaAlAs (gallium aluminum arsenide) laser diodes, e.g., used in Compact Disc (CD) drives.

SUMMARY

Techniques, systems and devices are described for controlling the adjustment of colors and optical power of output light of solid-state lighting devices for improved lighting performance.

In one aspect of the disclosed technology, a solid-state lighting system includes a lighting device and a control panel. The lighting device includes solid-state light emitters that emit light of different colors, driver circuits that respectively drive the solid-state light emitters, line sensing electronics that receives signal modulation on a power line to which the lighting device is connected to receive electrical power, a digital controller that decodes the received signal modulation from the line sensing electronics into a digital command, and a memory device that stores the decoded digital command. The digital controller retrieves the stored digital command to control the driver circuits based on the retrieved digital command to control at least one of color or optical power of the solid-state light emitters. The control panel is connected in the power line and sends the digital command to the lighting device via the power line. The control panel modulates the electrical power in the power line to produce the signal modulation that carries the digital command.

Implementations of the solid-state lighting system can optionally include one or more of the following features. For example, the control panel can be configured to include an identification (ID) address of the lighting device in the signal modulation, in which the digital controller in the lighting device can be configured to recognize the ID address that is associated with the lighting device and to ignore a received digital command that has a different ID address. In some implementations, the control panel can be configured to include a human interface for a user to enter a command, e.g., in which the human interface can include a touch screen display panel or a combination of a display panel and a user input key pad. In some implementations, the control panel can be configured to include a wireless interface including a wireless signal from a wireless communication device operated by a user to enter a command. For example, the digital controller can adjust a solid-state light emitter intensity by changing at least one of an amount of time the solid-state light emitter is turned on or a driving current that drives the solid-state light emitter. For example, the lighting device can include a light detection module including photo detectors operable to sense different wavelength spectrum of different solid-state light emitters in different separated color groups of the solid-state light emitters. In some implementations, for example, the lighting device can include a light mixing unit that receives light of different colors from the solid-state light emitters and mixes the received light of different colors to produce output light that is uniform in color. For example, the lighting device can include a brightness enhancement layer positioned to receive the output light that is uniform in color from the light mixing unit and to select a portion of the received output light that is uniform in color from the light mixing unit as output light in directions that are either perpendicular to, or at small angles with respect to the normal direction of, the brightness enhancement layer, e.g., which can include prisms that redirect received light by refraction or reflection. In some implementations, for example, the lighting device can include a brightness enhancement layer positioned to receive output light from the solid-state light emitters and to select a portion of the received output light from the solid-state light emitters as output light in directions that are either perpendicular to, or at small angles with respect to the normal direction of, the brightness enhancement layer, e.g., which can include prisms that redirect received light by refraction or reflection. In some implementations of the solid-state lighting system, the solid-state lighting system can further include a light detection system that includes one photo detector operable to measure intensities of different solid-state light emitters in different separated color groups at a different time domain when the solid-state light emitters of other separated color groups are turned off. In some implementations, the digital controller can be configured to, upon receiving a new digital command, control color or optical power of the light emitted by one or more of the solid-state light emitters to momentarily change the emitted light to effectuate a visual signal indicating receipt of the digital command. For example, the momentary change in the emitted light can include (1) a momentary change in the power of the emitted light to produce a blinking effect in the emitted light to effectuate the visual signal indicating receipt of the digital command, (2) a momentary change in the color of the emitted light to effectuate the visual signal indicating receipt of the digital command, or (3) a momentary change in both the power and color of the emitted light to effectuate the visual signal indicating receipt of the digital command.

In another aspect, a solid-state lighting device includes solid-state light emitters that emit light of different colors, driver circuits that respectively drive the solid-state light emitters, line sensing electronics that receives signal modulation on a power line to which the lighting device is connected to receive electrical power, a digital controller that decodes the received signal modulation from the line sensing electronics into a digital command, and a memory device that stores the decoded digital command, in which the digital controller retrieves the stored digital command to control the driver circuits based on the retrieved digital command to control at least one of color or optical power of the solid-state light emitters.

In another aspect, a method for controlling a solid-state lighting system includes coupling lighting devices in one or more power lines to provide electrical power to the lighting devices, each lighting device including solid-state light emitters that emit light of different colors, driver circuits that respectively drive the solid-state light emitters, line sensing electronics that receives signal modulation on the one or more power lines, a digital controller that decodes the received signal modulation from the line sensing electronics into a digital command, and a memory device that stores the decoded digital command, wherein the digital controller retrieves the stored digital command to control the driver circuits based on the retrieved digital command to control at least one of color or optical power of the solid-state light emitters; coupling a control panel in the one or more power lines to which the lighting devices are connected; operating the control panel to modulate the electrical power in the one or more power lines to send digital commands and respective ID addresses of respective lighting devices to the lighting devices via the one or more power lines; and operating a lighting device to respond to a respective digital command that is from the control panel and is targeted at the lighting device based on a respective ID address to control at least one of power or color of light output of the lighting device.

In another aspect, a solid-state lighting device solid-state light emitters that emit light of different colors, and a brightness enhancement layer positioned to receive output light from the solid-state light emitters and to select a portion of the received output light from the solid-state light emitters as output light in directions that are either perpendicular to, or at small angles with respect to the normal direction of, the brightness enhancement layer.

Various features are described in detail in the drawings, the description, and the claims.

BRIEF DESCRIPTION OF THE DRAWINGS

Like reference symbols and designations in the various drawings indicate like elements.

DETAILED DESCRIPTION

Figure 1:
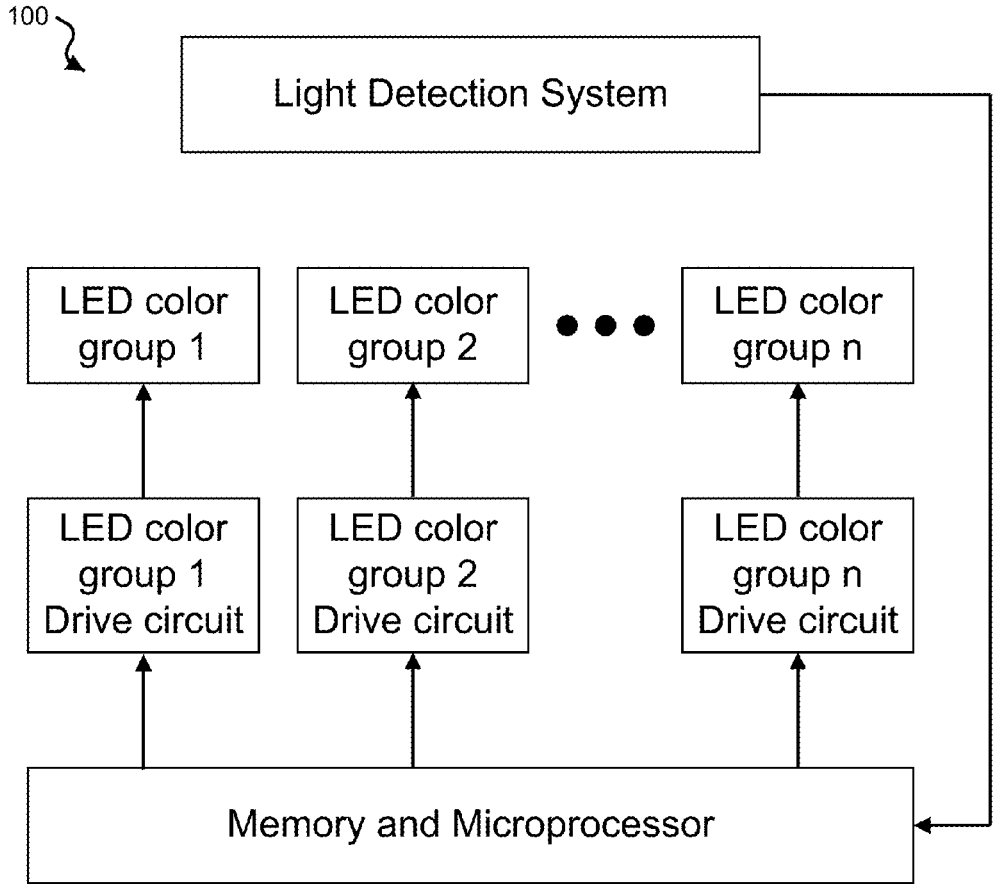
FIG. 1 shows a diagram illustrating an exemplary multiple-LED lighting module design for an LED lighting device.

The techniques, designs, and examples described in this document are directed to and applicable to energy-efficient lighting devices based on solid-state lighting devices such as semiconductor light-emitting diodes (LEDs), semiconductor laser diodes (LDs) and other light-emitting structures. The exemplary techniques, systems, devices, and designs described herein use LEDs as examples and can be applicable to lighting devices based on semiconductor laser diodes (LDs) and other light-emitting structures.

A semiconductor LED lighting device has certain light spectrum output. For example, multiple LEDs can be combined to produce a variety of color outputs that make up the light spectrum of a semiconductor LED lighting device, e.g. such as by using LED lights that emit light of different colors. Such LED lights that can emit light of different colors can be LEDs combined with different phosphor materials, in which the phosphor materials emit light of different color under optical excitation of the LED light, or can be LEDs based on semiconductor materials that emit light of different colors. However, due to the production variation of LED chips and/or differences in phosphor performance, an LED light spectrum of a single color may have variations from one LED light to another. Also, the LED light spectrum of a single color may also change over time due to aging and other time-dependent factors. The LED light intensity may change over time due to aging or a change in its environment. Any of these and other effects may cause the combined light output color to shift over time, or to vary between production lots.

Techniques, systems and devices are described for controlling the adjustment of colors and optical power of output light of solid-state lighting devices for improved lighting performance.

For example, based on some of the techniques described herein, an exemplary lighting device can include solid-state light emitters (e.g., LEDs or LDs) that emit light of different colors and are selected from groups of solid-state light emitters that emit light of two or more separated colors, e.g., including any two or more of selected colors, such as red, green, blue and/or yellow, among other colors. One or more solid-state light emitters are selected from each of the separated color groups. This exemplary lighting device can include a programmable device that stores or remembers desirable optical intensities of these groups of solid-state light emitters and a control circuit that individually controls light intensity of each of the separated color groups of solid-state light emitters. For example, the light control circuit is coupled to or in communication with the programmable device to receive the desirable optical intensities of these groups of solid-state light emitters. The light control circuit is operable to adjust the intensities of these groups of solid-state light emitters based on the desirable intensities.

In another exemplary implementation, the adjustable lighting device can include an optional light detection module that detects optical intensities of the separated color groups of solid-state light emitters. For example, the light control circuit is coupled to or in communication with the light detection module to receive measurements of optical intensities of the separated color groups of solid-state light emitters and is coupled to or in communication with the programmable device to receive the desirable optical intensities of these groups of solid-state light emitters.

In another aspect, a solid-state lighting module can be configured to include one or more solid-state light emitters (e.g., LEDs) from each of three or more separated colors groups, a light detection system that detects the optical intensities of these groups of LEDs, a programmable device that stores or remembers the desirable optical intensities of these groups of solid-state light emitters, and a control circuit that individually controls intensity of these groups of solid-state light emitters and uses the light detection system measurements to adjust the intensities of these groups of solid-state light emitters to the desirable intensities.

In some exemplary implementations of the adjustable lighting devices, the lighting device can be operated to provide the adjustment to offset or compensate for variations in the color and light power that are caused by various factors and thus enable the output of the lighting device to produce a desirable output in the presence of the variations to the lighting device.

For example, the disclosed adjustable lighting device can be used to ensure color production to meet certain color reproduction standards. For example, such an adjustable lighting device can be used for constructing solid-state illumination devices (e.g., LED illumination sources) to provide a color reproduction capability to meet the specification of a color rendition index or color rendering index (CRI) comparable to or better than some other lighting devices, e.g., such as traditional lighting devices using incandescent lamp or Xenon lamp which have CRI equal or better than 95 due to the blackbody radiation process of such light sources. One example of common white LEDs with luminescent materials (e.g., such as YAG based phosphors) on blue LEDs produces white color near blackbody locus with CRI typically around 80 due to, for example, low optical output at red and green spectrum range of commonly used luminescent materials. The disclosed adjustable lighting device and other device designs with multiple color groups described in this patent document can be used to address this challenge and to produce high CRI output.

For example, it can be technically difficult to provide a high CRI illumination source with a control mechanism for adjusting its color temperature during operation of the source. For various traditional illumination sources or other solid-state illumination devices, the color temperature can be pre-determined by choice of the filaments and/or the luminescent materials. The designs using multiple color groups and independent intensity control as described in this patent document enable a lighting device to produce adjustable color temperature and output lumen level while maintaining high CRI.

FIG. 1 shows a diagram illustrating one example of a multiple-LED lighting module design 100 for an LED lighting device. The lighting module 100 of the device includes multiple groups of LEDs emitting different colors for different groups, e.g., an LED color group 1, an LED color group 2, . . . , an LED color group n. The lighting module 100 of the device includes multiple power drive circuits that correspond to each of the LED color groups, e.g., an LED color group 1 drive circuit, an LED color group 2 drive circuit, . . . , an LED color group n drive circuit. The power drive circuits are configured to control the intensity of each LED color group output independently of the other LED color groups, in which the control can be provided through a programmable processing unit of the multiple-LED lighting module 100, e.g., such as a microcontroller, a microprocessor, or other suitable processing unit. As illustrated in FIG. 1, the lighting module 100 includes a memory in communication with the microprocessor, e.g., which can be configured inside the programmable processing unit or outside as an external device, e.g., built into the module. For example, the memory can be used to store the spectrum and power information of the each color group and one or multiple sets of control parameters to drive each color group, e.g., to archive one or multiple desirable color profiles. Such spectrum and power information storage to the memory can be implemented during the manufacturing process or can be programmed into the memory post the manufacturing. When the LED module is in use, the programmable processing unit (e.g., the microprocessor) can select the set of control parameters in the memory to control the respective group driver circuits to operate the different LED color groups so that desirable overall color profile and power output can be achieved.

In some implementations, for example, the lighting module 100 of the device can include a light detection system or module to measure the light output power of each LED color group, and the programmable processing unit (e.g., the microprocessor) can use the measurement data from the light detection module to adjust the light output intensity of each color group to ensure the LED module color profile and power output are fixed at some desirable values or within some desirable value ranges. This exemplary detection/control feedback design can be used to generate control parameters based on the actual measured data to ensure the light output level of each color group is at a desired level, e.g., rather than based on preset control parameters stored at the time of manufacturing of the device, in which such device performance parameters (e.g., such as LED output level) can be subject to inadvertent and undesirable changes over time due to aging and other environmental effects. For example, in the case of aging of the LEDs, or shift of the component value or environments, the exemplary detection/control feedback design can archive the desired light output level for each color group and for the whole LED module. For example, this combination of the light detection and feedback to the control circuit can be beneficial in various applications where the combined light output color of the module is dependent on the relative power output level of each color group, in which such light detection and feedback to the control circuit provides a mechanism to counter the effects caused by device aging, environments and other factors.

In some exemplary implementations, three color groups of light emitters using LEDs and/or LDs can be used in an intelligent control LED lighting device. For example, the three color groups of the LED lighting device can be configured with a blue group of light emitters (e.g., realized with blue LEDs), a yellow group of light emitters (e.g., realized with blue or UV LED plus yellow phosphors), and a red group of light emitters (e.g., realized with red LEDs, or LED with red phosphors, or red LDs). In another example, the three color groups can include a green group of light emitters (e.g., realized with green LEDs or realized with blue or UV LED plus green phosphors), a yellow group of light emitters (e.g., realized with blue or UV LED plus yellow phosphors), and a red group of light emitters (e.g., realized with red LEDs, or LED with red phosphors, or red LDs). In yet another example, the intelligent control LED lighting device can include four color groups configured with a blue group of light emitters (e.g., realized with blue LEDs), a yellow group of light emitters (e.g., realized with blue or UV LED plus yellow phosphors), a red group of light emitters (e.g., realized with red LEDs or red LDs), and a green group of light emitters (e.g., realized with green LEDs, blue LEDs with green phosphors, or green LDs). In yet another example, the intelligent control LED lighting device can include two groups of light emitters configured with a blue group of light emitters (e.g., realized with blue LEDs) and a yellow group of light emitters (e.g., realized with blue LED plus yellow phosphors).

Additional examples of color groups designs are provided below. In one example, the LED lighting device includes one group of solid-state light emitters (e.g., LEDs) having a blue color (e.g., dominant wavelength from 435 to 485 nm), one group of luminescent LEDs having a yellow color (e.g., dominant wavelength from 550 to 585 nm), and one group of LEDs having a red color (e.g., dominant wavelength from 610 to 640 nm). In another example, the LED lighting device includes one group of solid-state light emitters (e.g., LEDs) having a green color (e.g., dominant wavelength from 515 to 540 nm), one group of luminescent LEDs having a yellow color (e.g., dominant wavelength from 550 to 585 nm), and one group of LEDs having a red color (e.g., dominant wavelength from 610 to 640 nm). In another example, the LED lighting device includes one group of solid-state light emitters (e.g., LEDs) having a blue color (e.g., dominant wavelength from 435 to 485 nm), one group of solid-state light emitters (e.g., LEDs) having a green color (e.g., dominant wavelength from 515 to 540 nm), one group of luminescent LEDs having a yellow color (e.g., dominant wavelength from 550 to 585 nm), and a group of LEDs that have a color of red (e.g., dominant wavelength from 610 to 640 nm). In the above examples, the yellow luminescent LEDs can be made of a yellow luminescent material (e.g., such as but not limited to phosphors or quantum dots) excited by a blue or UV LED.

Figure 2:
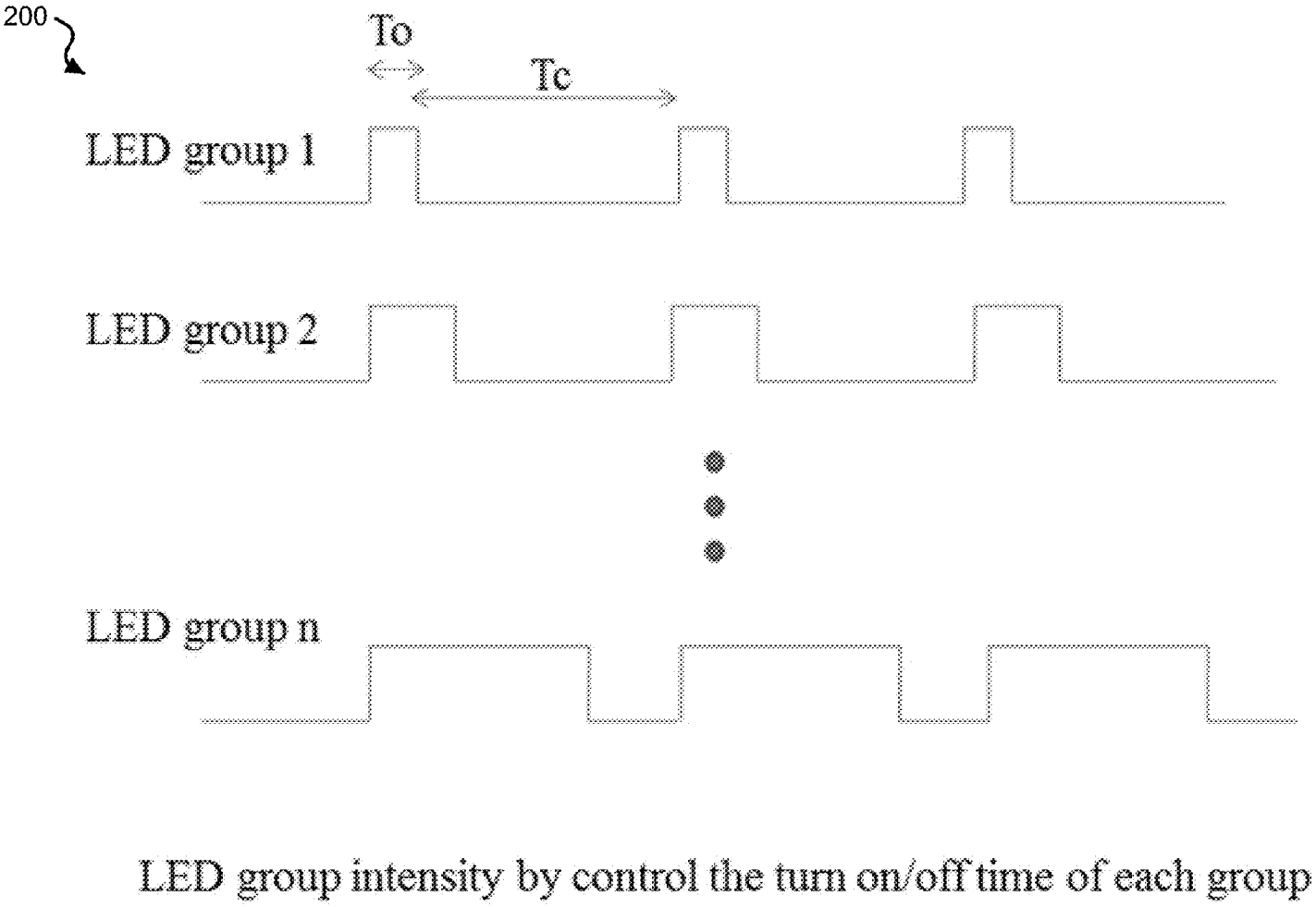
FIGS. 2, 3 and 4 show timing diagrams associated various control and detection features of the exemplary device in FIG. 1.

FIG. 2 shows a timing diagram 200 that illustrates an example for controlling the light output intensity of the LEDs by controlling the turn-on and turn-off times of the LEDs in the LED color groups. The diagram 200 indicates that by controlling the turn-on time (To) and turn-off time (Tc), e.g., such as the ratio between To and Tc, the light output intensity of each color group can be controlled.

Figure 3:
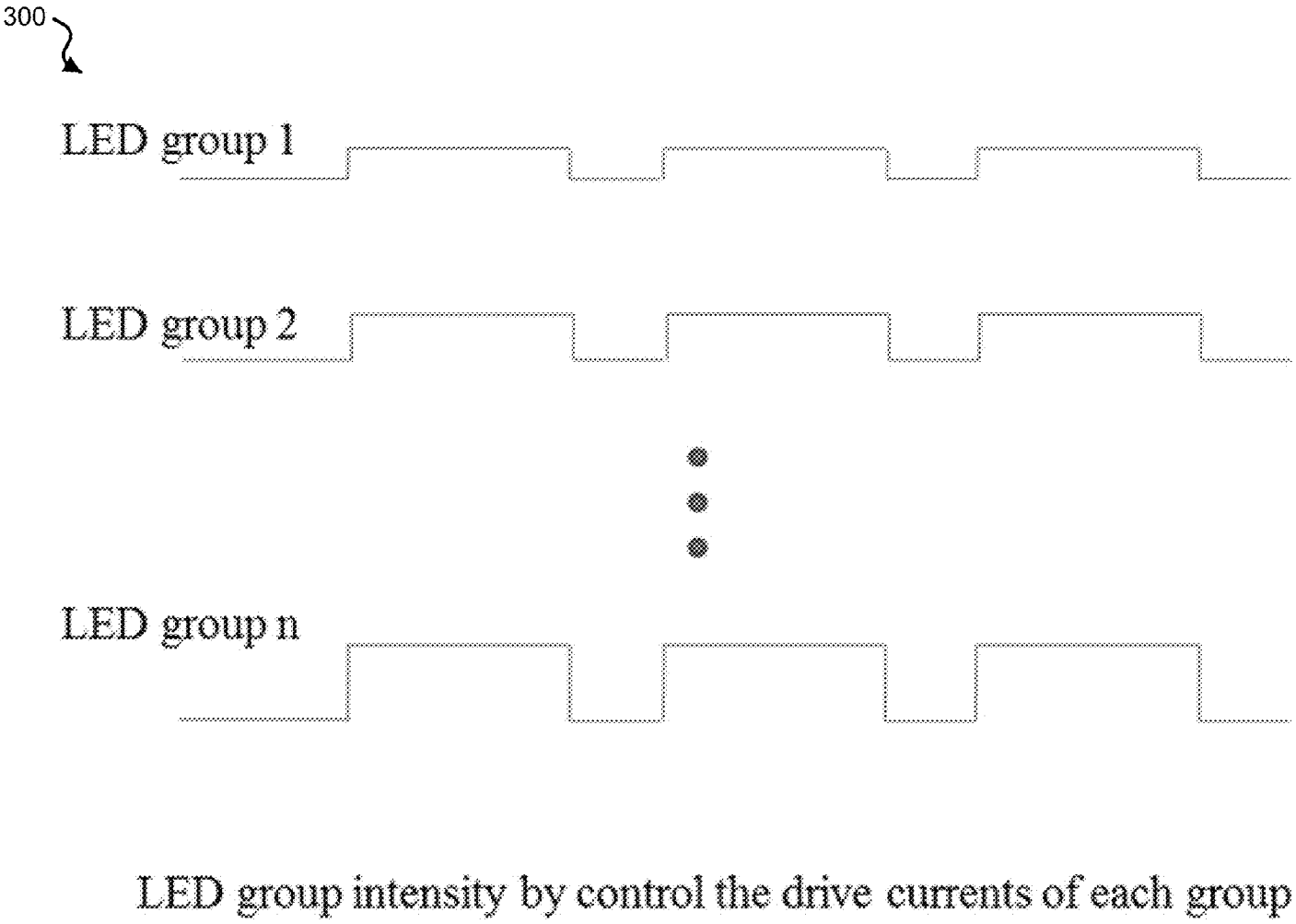

FIG. 3 shows a timing diagram 300 that illustrates another example for controlling the light output intensity of the LEDs by controlling the drive currents of each LED color group. The diagram 300 indicates that changing the intensity of the current for each LED color group can be used to control the light output intensity of each group.

In some implementations, the above control mechanisms for controlling the turn-on and turn-off times of the LEDs (exemplified in FIG. 2) and the light output intensities of LED groups (exemplified in FIG. 3) can be combined together.

Referring back to FIG. 1, the light detection system can be implemented in various configurations. For example, the light detection system can include different detectors that are designed to detect light outputs from the different LED color groups, respectively, e.g., which can be configured to have one detector per LED color group. In another example, the light detection system can include a single detector that detects light outputs of different LED groups at different times.

Figure 4:
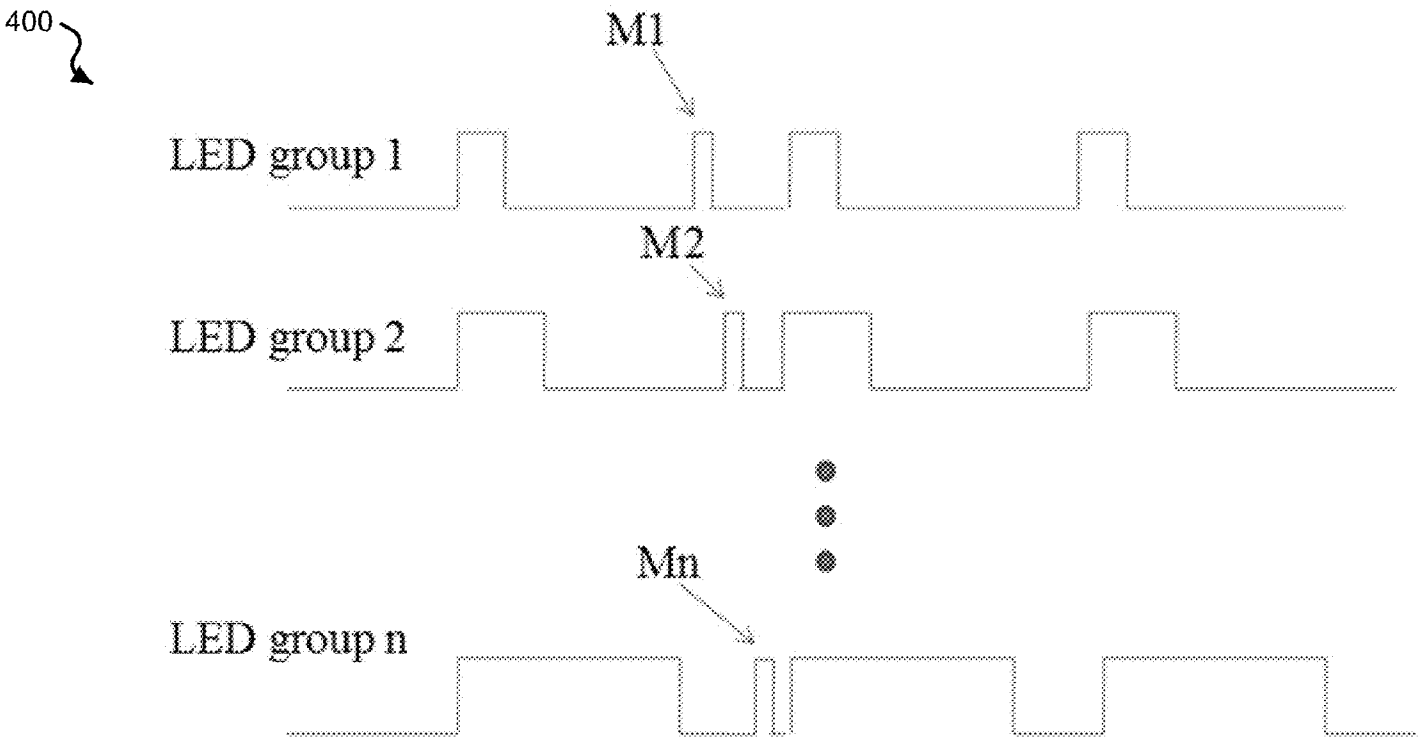

FIG. 4 shows a timing diagram 400 that illustrates an exemplary design to measure each color group light output intensity using just one channel of a light detection system. As shown in the timing diagram 400, during the off time of the LEDs, each LED color group is turned on in a very short period of time (e.g., 1 μs to 100 ms) independently while other LED color groups are turned off, so that the light detection system only measures light output from one color group only. For example, during the off time of the LED groups, the different LED color groups 1, 2, . . . and n are turned on momentarily at times as marked by M1, M2, . . . and Mn. The single detector light detection system can be used to receive light from all LED groups such that the single detector only detects output light from one LED group at a time. The measured data can be correlated with or corrected with the relative time each color group is turned on to calculate a correct output intensity of the color group. The detection results of the exemplary single detector light detection system, e.g., including the spectrum responses, can be used in the calculation of the light control parameters. This exemplary design reduces the need for having multiple detectors that are designated to measure their respective light colors, respectively (each detector is assigned to measure a particular color group).

Figure 5A:
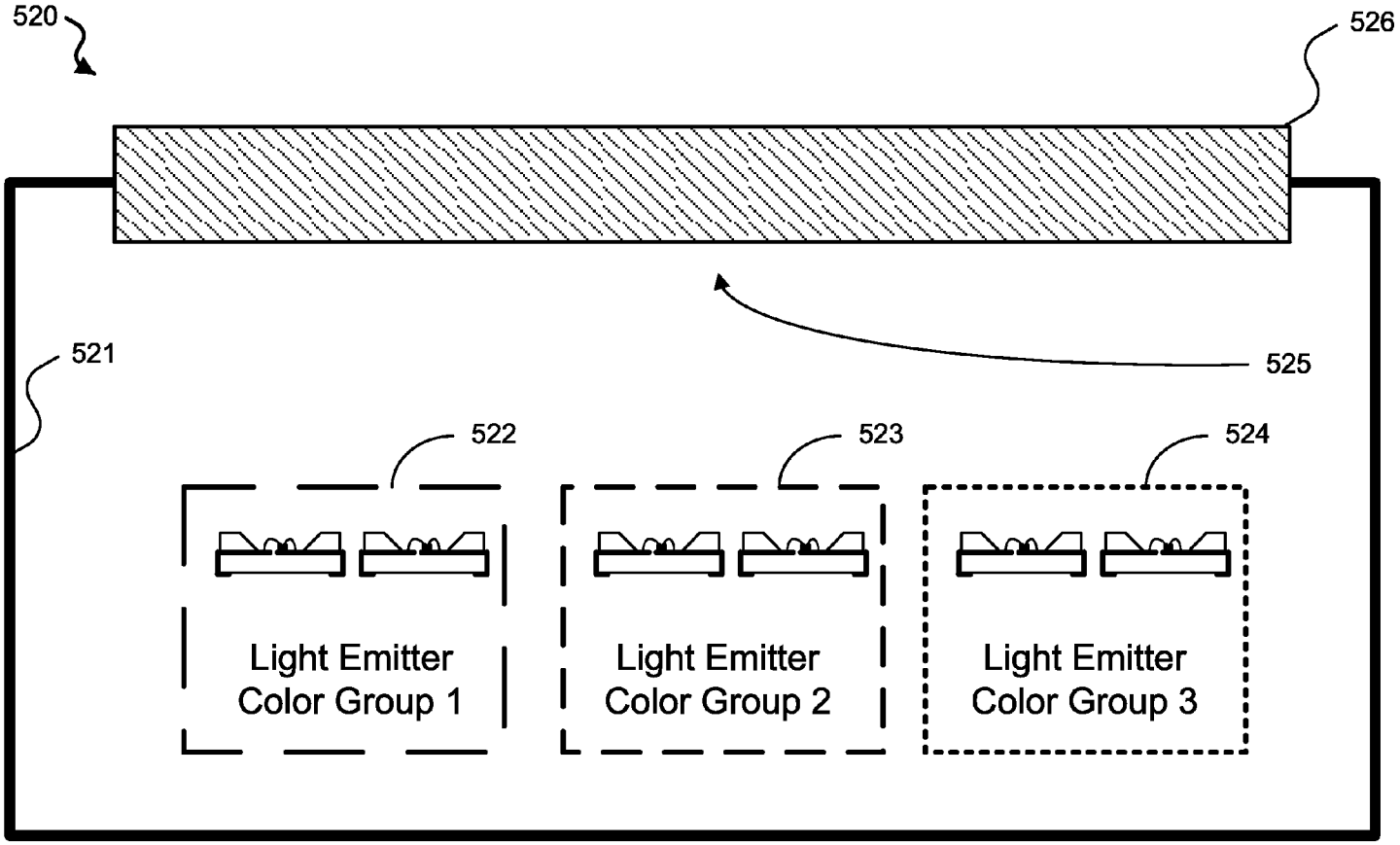
FIGS. 5A and 5B show diagrams of exemplary lighting modules for a multiple-light emitter lighting device including a light mixer component.

FIG. 5A shows a diagram of an exemplary LED-based lighting module design 520 for a multiple-light emitter lighting device, such as the LED lighting module 100 in FIG. 1. In this example, the lighting module 520 includes multiple color groups of LEDs 522, 523, and 524 that are placed in a light fixture housing 521 and configured to emit light towards a light output port 525 formed on the light fixture housing 521. On the light output port 525, a light mixer 526 is formed to mix the light from different LED color groups 522, 523, and 524, so that the output light is more uniform in color. In some implementations of the lighting module 520, the light mixer 526 can be configured as a film that is made out of an array of micro structure lenses or other micro structure as in our other disclosure. In some implementations, the light fixture housing 521 can be made with reflective inner surfaces. For example, in some implementations, the LEDs from the different light emitter color groups 522, 523, and 524 can be placed alternatively spatially and/or in a mixed pattern, e.g., to achieve the desired color mixing at the light mixer 526. For example, a desired color output profile can be achieved by adjusting the relative power output between the color groups. A light detection module, such as the light detection system of the multiple-LED lighting module 100 in FIG. 1, can be located so that the light mixing film 526 is located between LEDs and the light detection module. A programmable processing unit, such as the microprocessor and memory of the multiple-LED lighting module 100 in FIG. 1, can be electrically coupled to the light emitter color groups 522, 523, and 524 inside or outside of the light fixture housing 521.

In exemplary implementation of the lighting module design 520, three color groups can be used as shown in FIG. 5A. For example, the light emitter color group 522 can be configured to emit primarily blue color light; the light emitter color group 523 can be configured to emit primarily yellow color light; and the light emitter color group 524 can be configured to emit primarily red color light. The power intensity of each color group can be independently adjusted, e.g., by either controlling the current of the LEDs or the turn-on time of the LEDs in the light emitter color groups. In some implementations, for example, the light detection system can be made with photosensitive elements to measure the intensity of the light output for each LED groups. The measurement data can be fed to the exemplary processing unit (e.g., the microcontroller) that controls the drive current of LED or turn-on time.

Figure 5B:
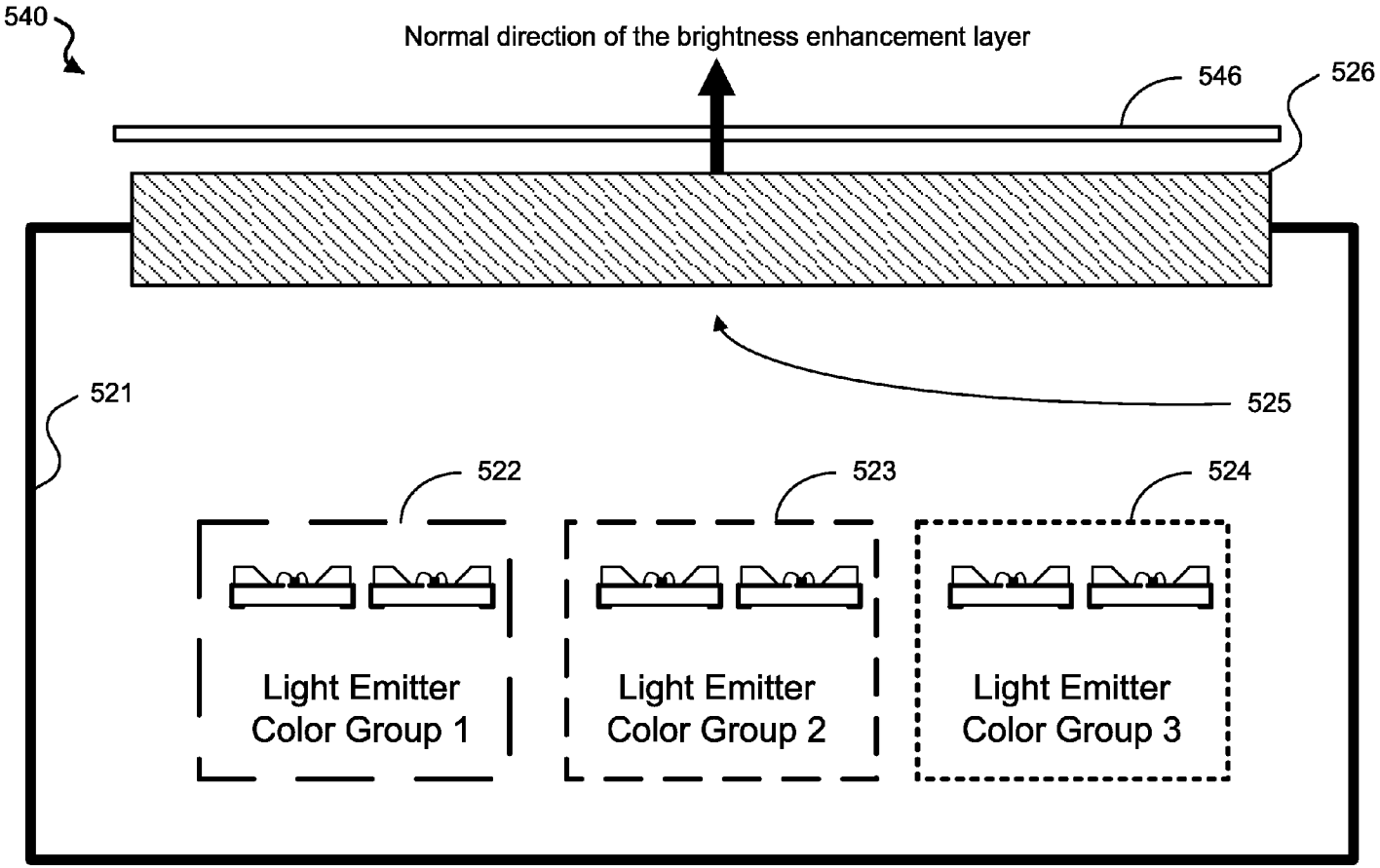

FIG. 5B shows a diagram of another exemplary LED-based lighting module design 540 of a multiple-light emitter lighting device based on the light mixer 526 in FIG. 5A with an additional brightness enhancement layer 546 configured above the light mixer 526. The brightness enhancement layer 546 is structure to receive the light produced by the LED module and select light rays to output at directions that are, for example, either perpendicular to the layer or at small angles that are less than a threshold angle (e.g., at the normal direction of the layer), to transmit as output light, so that such output light is more directional than the output light in absence of the brightness enhancement layer 546. For example, the improved directionality of such output light from the brightness enhancement layer 546 of the lighting module 540 results in the output light appearing to be brighter and better focused on a desired direction or target. The remaining incident light that is not selected for transmission by the brightness enhancement layer 546 is directed back to, and recycled within, the LED module 540 and will be redirected back to the brightness enhancement layer 546 for further output selection. The brightness enhancement layer 546 can provide an improvement in the overall directionality and brightness of the output light of the LED module 540 and overall optical efficiency of the LED module 546 in the multiple-LED lighting device.

The brightness enhancement layer 546 shown in FIG. 5B can be implemented in various exemplary configurations. In one example, the brightness enhancement layer 546 can include the commercial brightness enhancement films (BEFs) by 3M based on an array of micro prisms for LCD display panels. In one example, the 3M Vikuiti™ Brightness Enhancement Films (BEF) includes a microreplicated prism structure is included to increase the brightness of liquid crystal displays through improved management of the existing light created by the backlight by focusing the light toward the user.

Figure 5C:
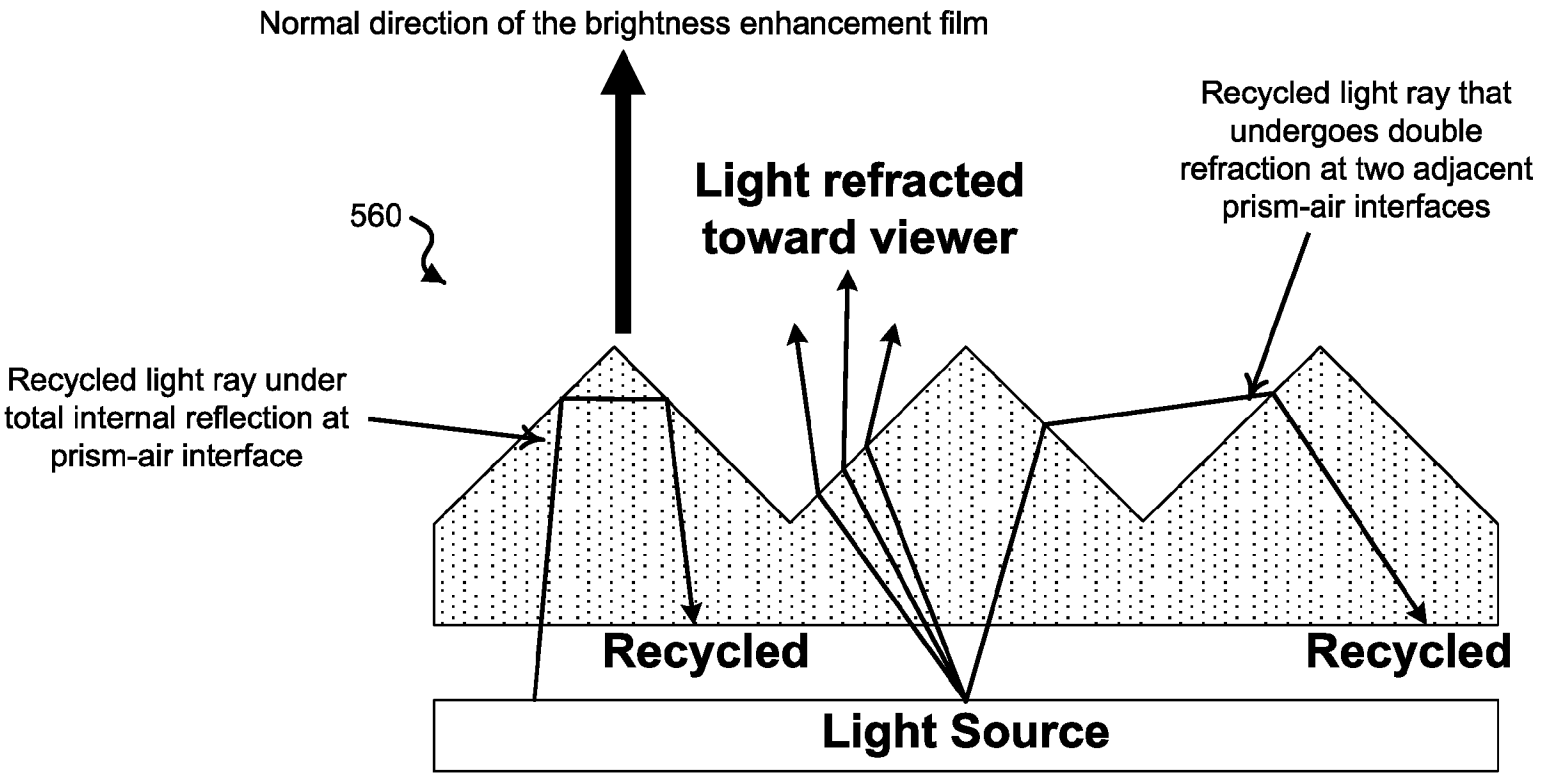
FIG. 5C shows an example of a brightness enhancement film for the exemplary lighting modules in FIGS. 5A and 5B.

FIG. 5C shows a diagram of an exemplary brightness enhancement film 560 such as the 3M Vikuiti™ BEF. As shown in the figure, light incident to the BEF 560 at certain angles is selected to transmit through the BEF by optical refraction, e.g., which is either perpendicular to the BEF or at small angles. The remaining received light by the BEF 560 are reflected back via the total internal reflection at the prism-air interfaces or double refraction at two adjacent prism-air interfaces. One or more such BEFs can be used as the brightness enhancement layer 546 of the LED module 546, as shown in FIG. 5B, in the multiple-LED lighting devices of the disclosed technology. In some implementations, for example, a single sheet of the Vikuiti™ BEF film can be used to increase brightness up to 60% or two sheets crossed at 90 degrees to each other can be used to increase brightness by up to 120%.

Figure 5D:
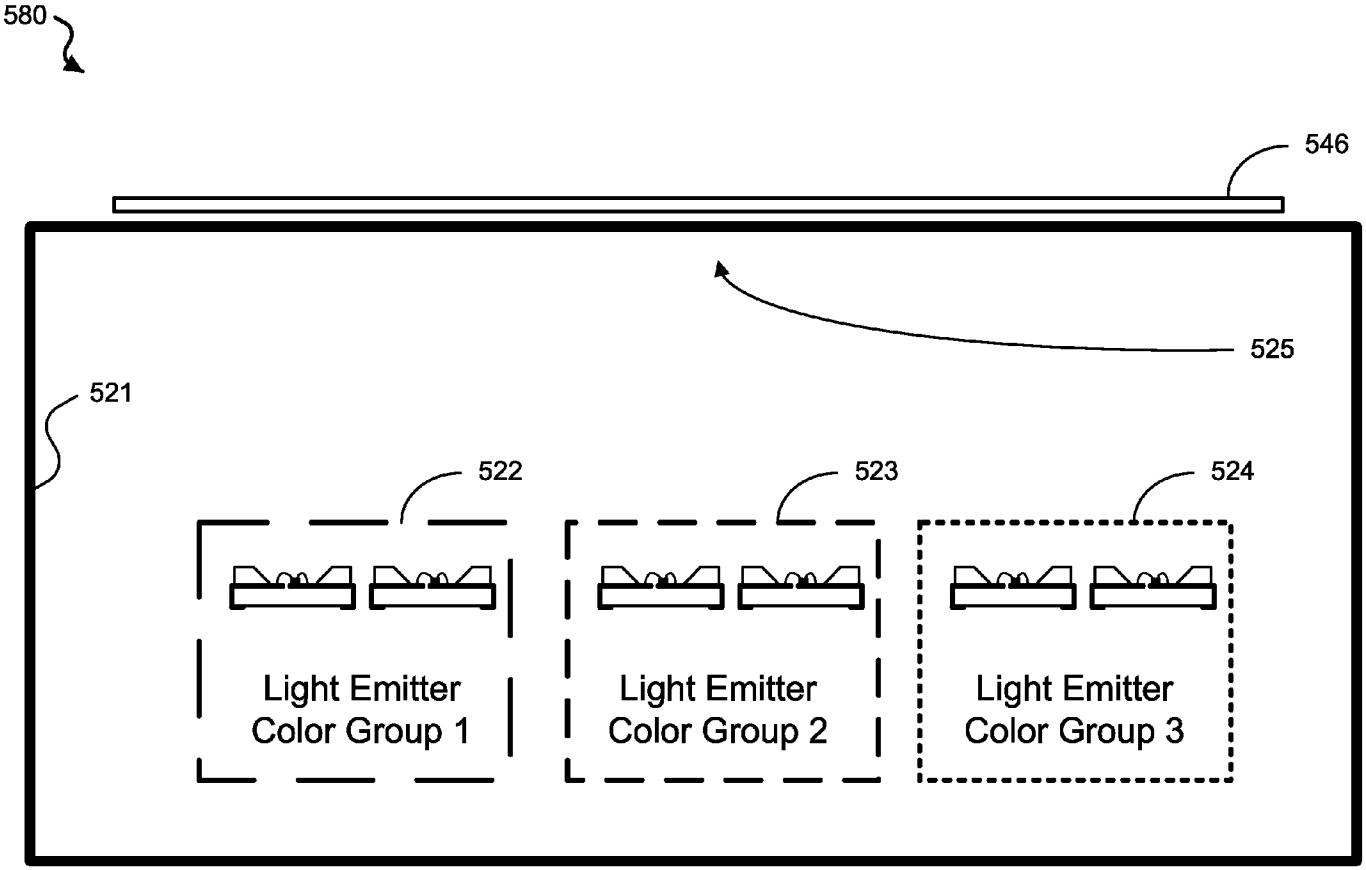
FIG. 5D shows a diagram of another exemplary lighting module including the brightness enhancement layer in FIG. 5C.

FIG. 5D shows a diagram of another exemplary LED-based lighting module design 580 of a multiple-light emitter lighting device that implements the brightness enhancement layer 546, e.g., such as the BEF 560 in FIG. 5C, without the light mixing film 526.

Figure 6:
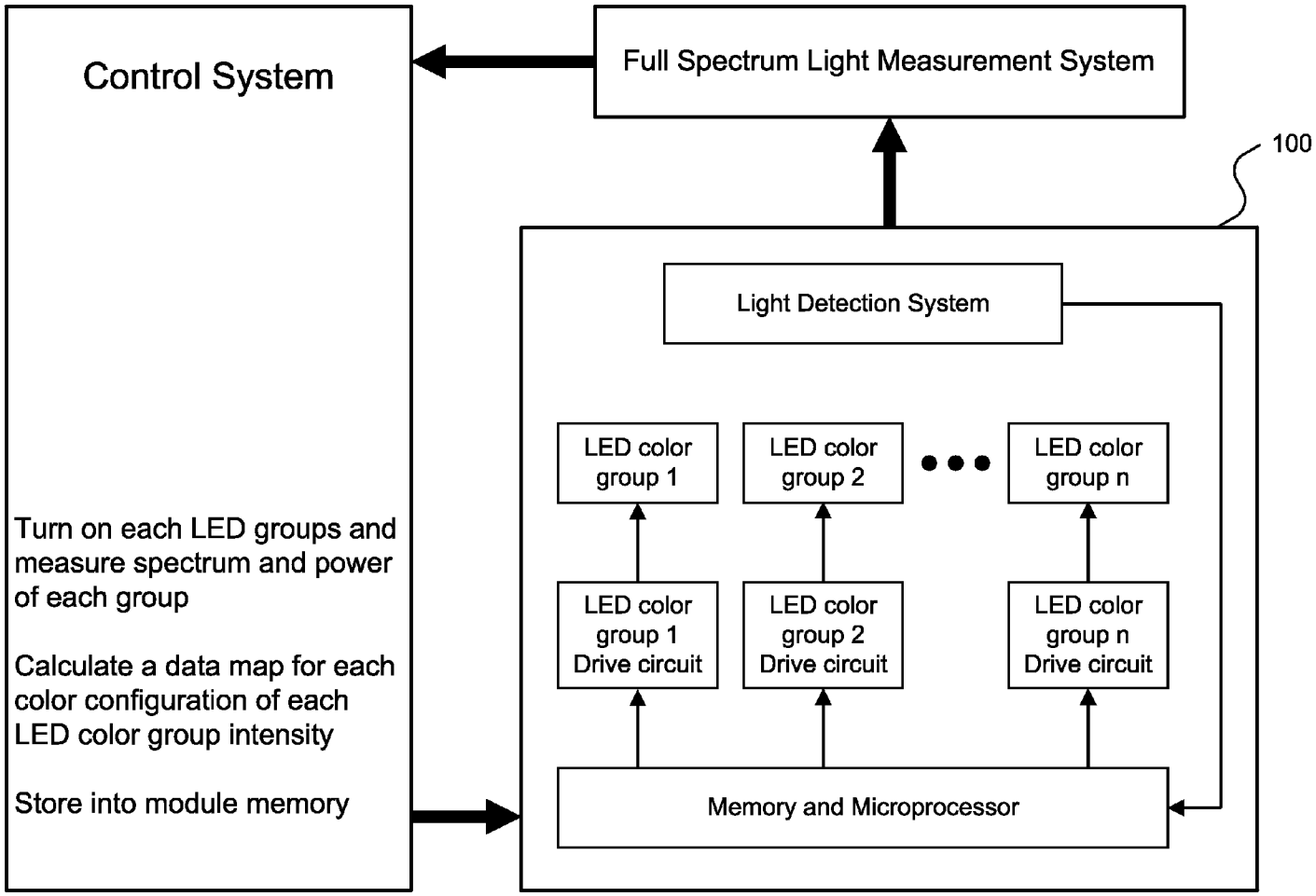
FIG. 6 shows a diagram illustrating a method of configuring a lighting module during a manufacturing process.

FIG. 6 shows a block diagram illustrating a method of configuring the lighting module during the manufacturing. For example in the manufacture process, a light spectrum measurement and intensity measurement system is used to measure each LED color group output light. The measurement information is used to calculate a table of relative light output intensity data for each LED color group and the corresponding module output light profile. This information is stored in the memory of each LED lighting module. Thus, each LED lighting module is individually calibrated to correct its LED chip wavelength and power variations, phosphor performance variation, and their temperature dependences and aging effects. For example, the power correction is performed by adjusting each color group drive current or turn-on time. For example, the color profile correction is performed by adjusting relative power ratios between each color groups. For example, if a high temperature output light profile is needed, a blue LED group can be controlled to produce a relative higher intensity with respect to the red LED group. Also for example, a lower temperature, warmer color output profile can be made by increasing the red LED group output power.

In the above examples, the control parameters can be set during operation of the lighting device based on stored values of the control parameters for the LED color groups (e.g., of different colors) in the memory or based on values of the control parameters based on measured data by the light detection system. In addition, the control parameters can be set during operation of the lighting device based on the use input via an user control that is entered by a user via a user interface, e.g., such as a dimmer switch physically connected to the lighting device in the power line to control the lighting device, or via another device such as a wireless or wired communication device that sends out the user control command to the lighting device, or a control circuit that is connected to the lighting device that carries out the user command initiated by the user on the wireless or wired communication device. Examples of a wireless communication device include a mobile phone or a tablet or computer with wireless communication capability via a wireless communication network, e.g., such as WiFi or mobile network. Some examples for wireless communications of a wireless communications device include 3G wireless communication standards, 4G wireless communication standards including, LTE, WiFi, Bluetooth, Bluetooth LE, and other suitable wireless communications via radio frequency waves and other electromagnetic waves. Some examples of a wired communication device include a computer connected to a communication cable to a communication network.

Figure 7:
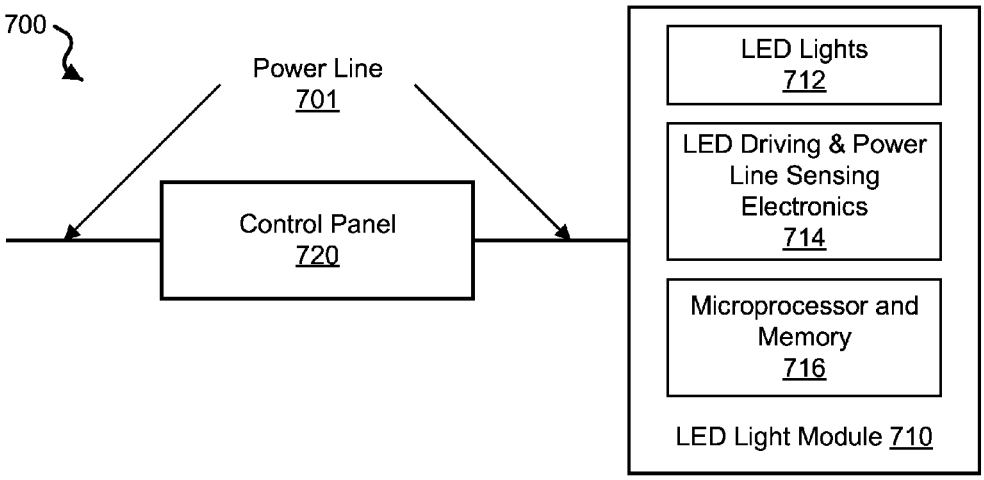
FIG. 7 shows a diagram of an exemplary lighting system of the disclosed technology.

FIG. 7 shows a diagram of an exemplary lighting system 700. The lighting system 700 includes a lighting control panel 720 connected to a power line 701 of an LED lighting module or device 710 for controlling the operation of the LED lighting module or device 710. The LED lighting module 710 can be configured in a lighting device that is engaged to a lighting fixture via the power line 701, e.g., including, but not limited to, a conventional light socket with threads for receiving a light bulb commonly used in office, home, and/or commercial lighting systems. The LED lighting module 710 includes LED lights 712 driven by LED light drivers in an LED driving and power line sensing electronics module 714 built into the LED lighting module or device 710. The LED lighting module 710 also includes a local control circuit 716 including a local memory and digital control device (e.g., a digital controller such as a microprocessor) that controls the operation of the LED light drivers in the module 714. In operation, the LED light drivers in the module 714 can directly receive electrical power from the power line 701 and can control the power delivery to the LED lights 712 to control the power output and the generated color by the LED lighting module or device 710. The LED light drivers in the module 714 can be configured to be slaved to the local control circuit 716 and be under control of the local control circuit 716 to control the power delivery to the LED lights 712. The local control circuit 716 and the lighting control panel 720 can be configured in communication with each other via communication signals modulated on the current or voltage in the power line 701, e.g., such that user commands from the lighting control panel 720 are delivered to the local control circuit 716 which, in turn, controls the LED light drivers in the module 714 based on the received user commands from the lighting control panel 720.

Figure 8:
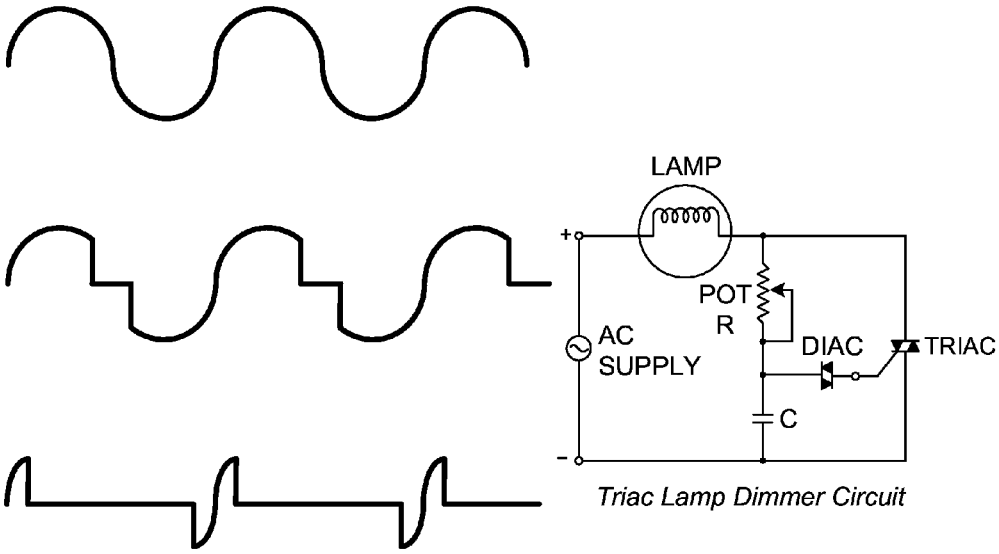
FIG. 8 shows an exemplary dimmer switch circuit and timing diagrams for controlling dimming of a lamp based on a triac switch.

In various traditional lighting systems, dimmer switches can be used to control output light levels of a lighting device. FIG. 8 illustrates an example of a dimmer switch circuit for controlling dimming of a lamp based on a triac switch. The left side of FIG. 8 shows timing diagrams showing waveforms of the exemplary dimmer switch circuit shown in the diagram on the right side of FIG. 8. As shown in the timing diagrams of FIG. 8, the top waveform represents a full power level at the lamp of the dimmer switch circuit, the middle waveform represents a middle power level at the lamp dimmer switch circuit, and the lower waveform represents a low power level at the lamp dimmer switch circuit.

For example, to a certain extent, the lighting control panel 720 can be analogous in one aspect of its function to a dimmer switch used in many lighting systems where the dimmer switch can control the light level of a lighting device. However, the lighting control panel 720 is also completely different from a dimmer switch in other aspects. For example, the lighting control panel 720 is a digital signal modulator that modulates a user command as a digital signal onto the current or voltage in the power line 701. This digital signal modulated signal is sensed by power line sensing electronics inside the module 714, e.g., which demodulates the received signal to produce a demodulated signal. The digital controller (e.g., a microprocessor) in the local control circuit 716 decodes the demodulated signal from the power line sensing circuit of the module 714 as a digital command and stores the digital command into the memory of the local control circuit 716. The digital controller then uses the stored digital command to control the LED light drivers of the module 714 in operating the LED lights 712.

Figure 9:
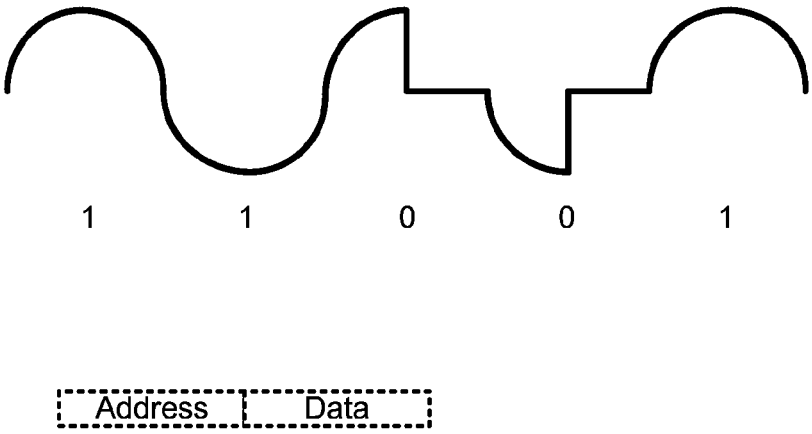
FIG. 9 shows an exemplary waveform diagram of modulated current or voltage output by the lighting control panel of the exemplary lighting system.

FIG. 9 shows an exemplary waveform diagram of the modulated current or voltage output by the lighting control panel 720 for sending digital commands to the LED lighting device 710 via the power line 701. Here the waveform represents digital bits in the command. In this example, the beginning portion of the waveform includes bits for the address or identification number of an LED lighting device in the system and second portion of the waveform includes bits for the digital command for operating a particular LED lighting device as identified by the address portion. With this exemplary data structure for the digital command, the local digital controller in a corresponding LED lighting device can recognize this ID. If, for example, this ID does not match, the local digital controller can discard the command since the command is apparently intended for another LED lighting device.

In some implementations, the timing diagrams of FIGS. 2 and 3 represent examples of outputs of the LED light drivers under the above control by the lighting control panel 720. The intensities of different LED color groups can be adjusted so total output light can be controlled to have desirable different color profiles. For example, by increasing the relative intensities of the yellow and red LED groups, the output light can be tuned to the warmer color direction, while increasing the relative intensity of the blue light group can tune the output light to the cooler color direction.

Figure 10:
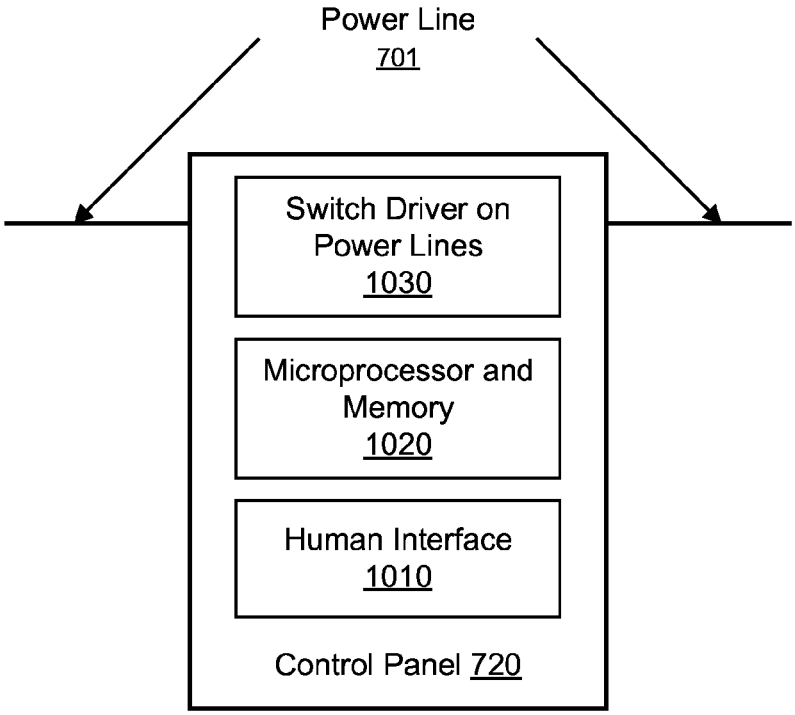
FIG. 10 shows a diagram of an exemplary embodiment of the lighting control panel shown in FIG. 7.

FIG. 10 shows a diagram of an exemplary embodiment of the lighting control panel 720 of FIG. 7. In this example, the control panel 720 includes a human interface 1010 for a user to input user commands, e.g., such as a touch screen display panel or a combination of a display panel and a user input key pad. The control panel 720 includes a control circuit 1020 that includes a digital controller (e.g., microprocessor) and a local memory. The control panel 720 includes a signal modulator 1030, e.g., which can operates like a switch driver, to modulate a waveform representing a digital command onto the power lines 701. For example, the digital controller in the control circuit 1020 stores the received command in its memory and translates the user command from the human interface 1010 into a modulation command that controls the signal modulator 1030.

Figure 11:
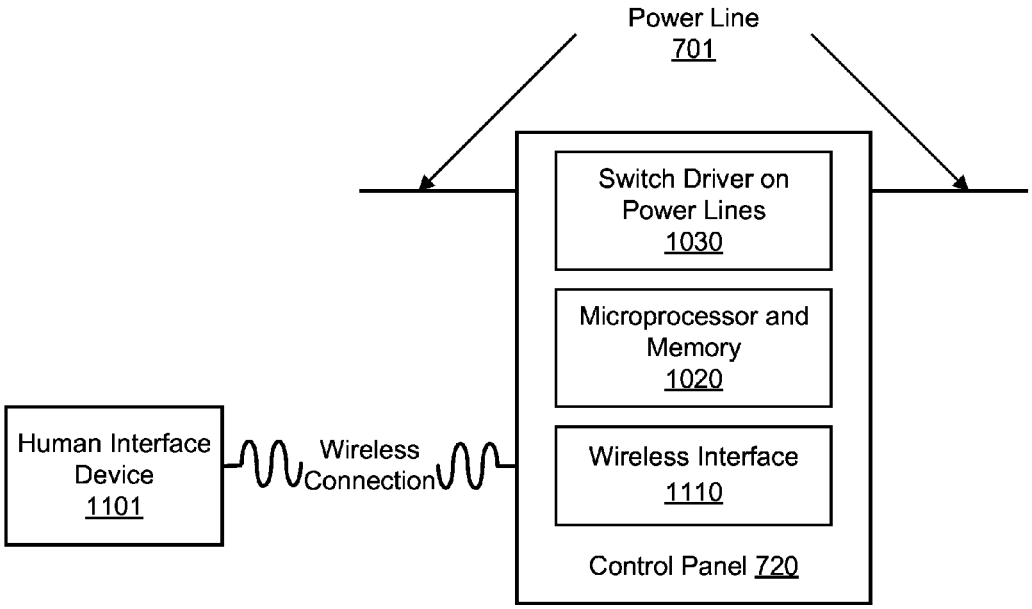
FIG. 11 shows a diagram of another exemplary embodiment of the lighting control panel shown in FIG. 7.

Alternatively, for example, the lighting control panel 720 of FIG. 7 may be a panel that is in wireless communication with a wireless user device to wirelessly receive user commands. FIG. 11 shows an example of this implementation where the lighting control panel 720 implements a wireless interface 1110, e.g., rather than the user interface 1010 as described in FIG. 10. A wireless user device 1101 is operated by a user to wirelessly send the user commands to the control panel 720, which are received via the wireless interface 1110. The other components 1020 and 1030 of the control panel 720 can be configured similar to the design in FIG. 10.

Figure 12:
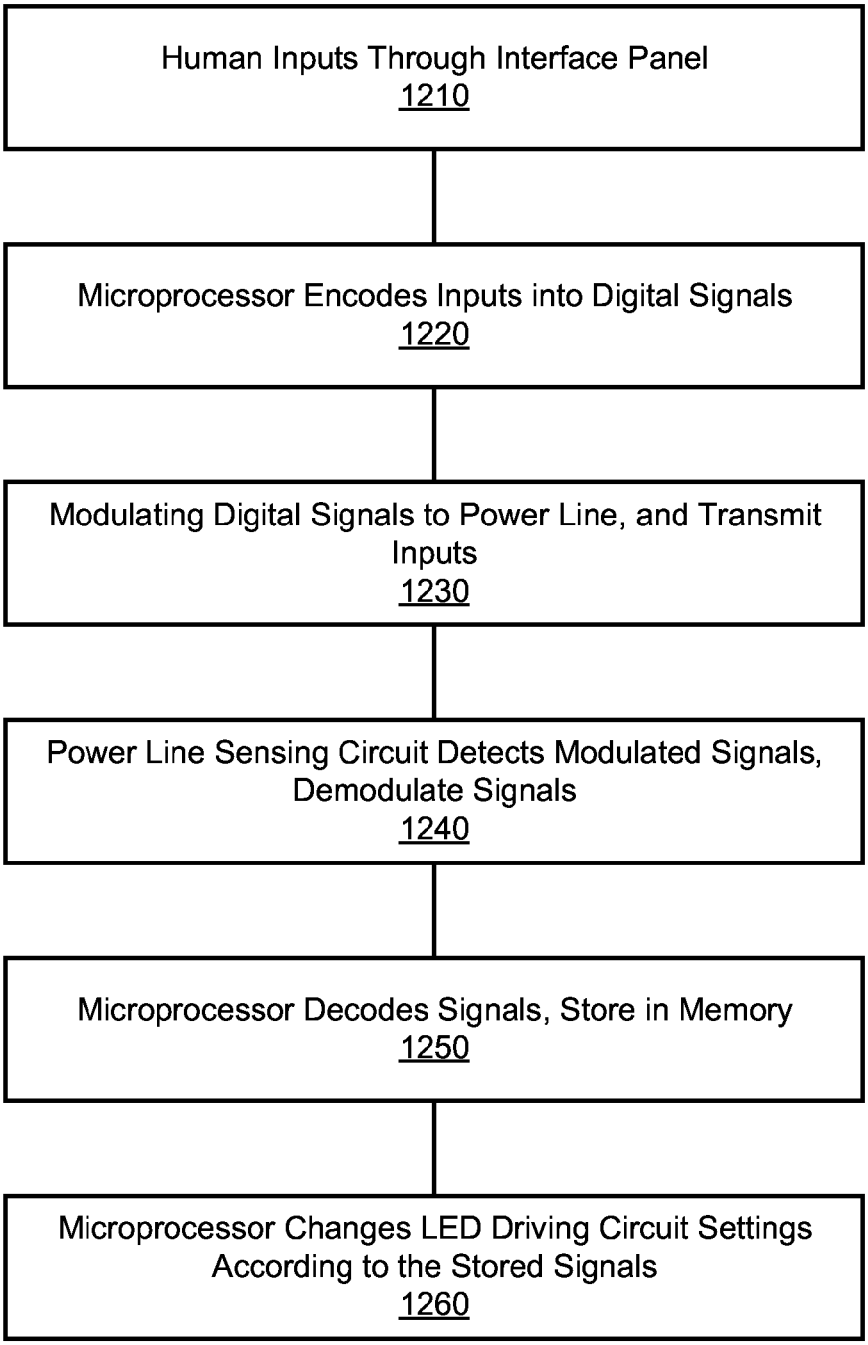
FIG. 12 shows a process diagram of an exemplary operating method for control of the lighting control system.

FIG. 12 shows a process diagram of an exemplary operating method for control of the exemplary lighting system in FIG. 7, e.g., under both control panel designs in FIGS. 10 and 11.

Figure 13:
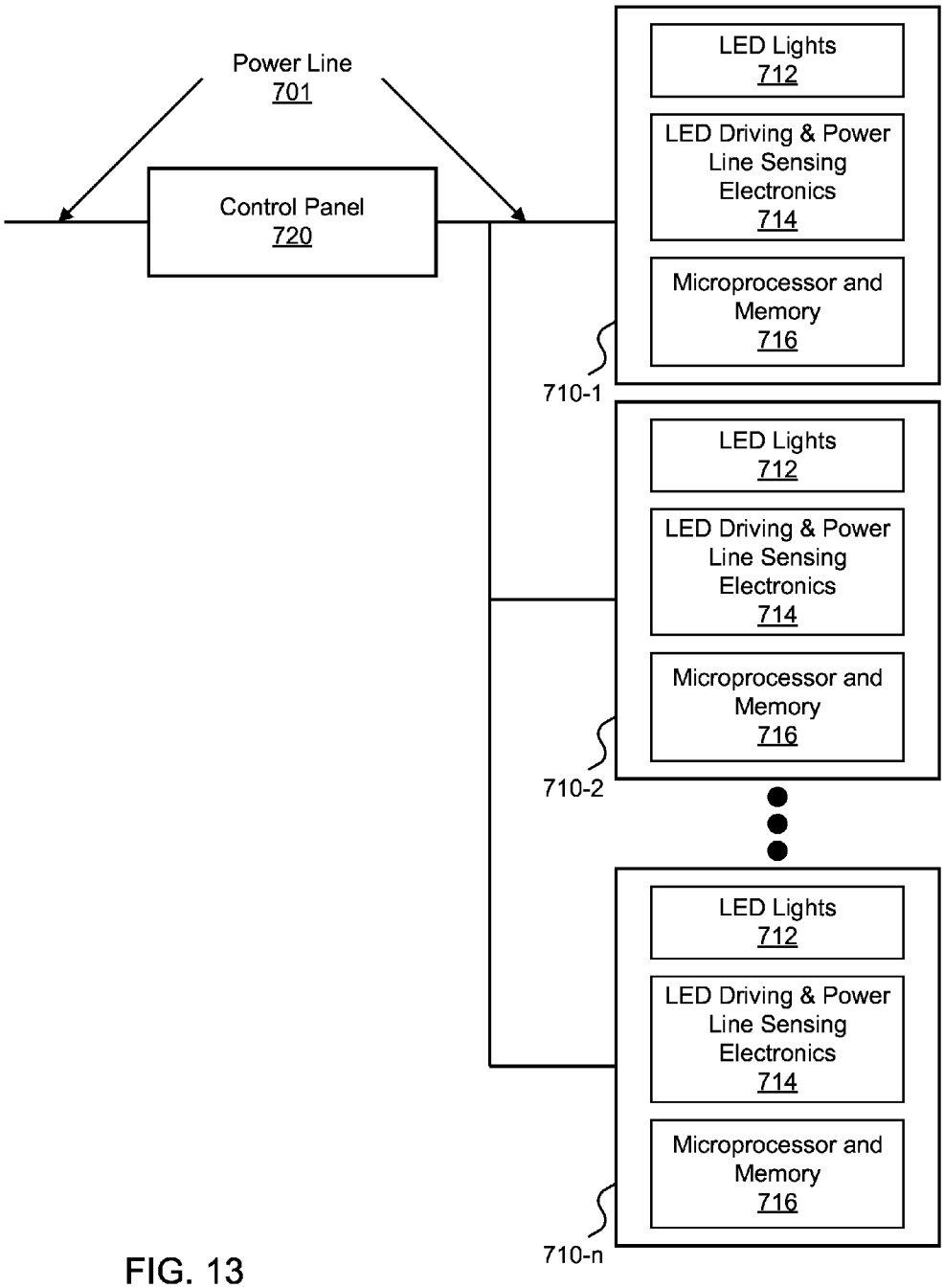
FIG. 13 shows a diagram of an exemplary lighting system with multiple LED lighting devices under control by the control panel.

FIG. 13 shows a diagram of an exemplary lighting system with multiple LED lighting devices 710-1, 710-2, . . . , and **710-*n* under control by the lighting control panel 720. The user commands from the control panel 720** include their respective device ID addresses so the digital controller in a targeted LED lighting device can recognize its device ID address and, based on this device ID address, the digital controller only decodes the properly-addressed command to carry out the operations.

In the above exemplary LED lighting devices or systems with the intelligent switch control, a visual indicator may be incorporated in the LED lighting devices or systems to enable a visual cue is generated when an LED light receives data or command from the switch/control unit. This visual cue can be a "blink" in a pattern or other change in the emitted light to be visible to give the user a feedback or acknowledgment that the data or command is received. This visual cue to the user can indicate to the user whether the received command produces the desired lighting effect as desired by the user and provide the user with an opportunity or option to, based on the resulted lighting effect of a previously sent data or command, send another command or to resend the command.

In implementations, the digital controller can be configured to, upon receiving a new digital command, control color or optical power of the light emitted by one or more of the solid-state light emitters to momentarily change the emitted light to effectuate a visual signal indicating receipt of the digital command from the user. For example, the momentary change in the emitted light can include a momentary change in the power of the emitted light to produce a blinking effect in the emitted light to effectuate the visual signal indicating receipt of the digital command. For another example, the momentary change in the emitted light includes a momentary change in the color of the emitted light to effectuate the visual signal indicating receipt of the digital command. For yet another example, the momentary change in the emitted light includes a momentary change in both the power and color of the emitted light to effectuate the visual signal indicating receipt of the digital command.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described, and other implementations, enhancements and variations can be made based on what is described and illustrated in this patent document.

What is claimed is:

1. A solid-state lighting system, comprising:

a lighting device that includes solid-state light emitters that emit light of different colors, driver circuits that respectively drive the solid-state light emitters, line sensing electronics that receives signal modulation on a power line to which the lighting device is connected to receive electrical power, a digital controller that decodes the received signal modulation from the line sensing electronics into a digital command, and a memory device that stores the decoded digital command, wherein the digital controller retrieves the stored digital command to control the driver circuits based on the retrieved digital command to control at least one of color or optical power of the solid-state light emitters; and a control panel connected in the power line to which the lighting device is connected, the control panel configured to send the digital command to the lighting device via the power line and to modulate the electrical power in the power line to produce the signal modulation that carries the digital command, wherein the digital controller is configured to, upon receiving a new digital command, control color or optical power of the light emitted by one or more of the solid-state light emitters to momentarily change the emitted light to effectuate a visual signal indicating receipt of the digital command, and wherein the control panel is configured to include a wireless interface that includes a wireless signal from a wireless communication device operated by a user to enter a command.

2. The solid-state lighting system of claim 1, wherein the control panel is configured to include an identification (ID) address of the lighting device in the signal modulation, and wherein the digital controller in the lighting device is configured to recognize the ID address that is associated with the lighting device and to ignore a received digital command that has a different ID address.

3. The solid-state lighting system of claim 1, wherein the control panel is configured to include a human interface for a user to enter a command.

4. The solid-state lighting system of claim 3, wherein the human interface includes at least one of a touch screen display panel or a combination of a display panel and a user input key pad.

5. The solid-state lighting system of claim 1, wherein the digital controller adjusts a solid-state light emitter intensity by changing at least one of an amount of time the solid-state light emitter is turned on or a driving current that drives the solid-state light emitter.

6. The solid-state lighting system of claim 1, wherein the lighting device includes a light detection module that includes photo detectors operable to sense different wavelength spectrum of different solid-state light emitters in different separated color groups of the solid-state light emitters.

7. The solid-state lighting system of claim 1, further comprising:

a light detection system that includes one photo detector operable to measure intensities of different solid-state light emitters in different separated color groups at a different time domain when the solid-state light emitters of other separated color groups are turned off.

8. A solid-state lighting system, comprising:

a lighting device that includes solid-state light emitters that emit light of different colors, driver circuits that respectively drive the solid-state light emitters, line sensing electronics that receives signal modulation on a power line to which the lighting device is connected to receive electrical power, a digital controller that decodes the received signal modulation from the line sensing electronics into a digital command, and a memory device that stores the decoded digital command, wherein the digital controller retrieves the stored digital command to control the driver circuits based on the retrieved digital command to control at least one of color or optical power of the solid-state light emitters; and a control panel connected in the power line to which the lighting device is connected, the control panel configured to send the digital command to the lighting device via the power line and to modulate the electrical power in the power line to produce the signal modulation that carries the digital command, wherein the digital controller is configured to, upon receiving a new digital command, control color or optical power of the light emitted by one or more of the solid-state light emitters to momentarily change the emitted light to effectuate a visual signal indicating receipt of the digital command.

9. The solid-state lighting system of claim 8, wherein the momentary change in the emitted light includes a momentary change in the power of the emitted light to produce a blinking effect in the emitted light to effectuate the visual signal indicating receipt of the digital command.

10. The solid-state lighting system of claim 8, wherein the momentary change in the emitted light includes a momentary change in both the power and color of the emitted light to effectuate the visual signal indicating receipt of the digital command.

11. The solid-state lighting system of claim 8, wherein the momentary change in the emitted light includes a momentary change in the color of the emitted light to effectuate the visual signal indicating receipt of the digital command.

12. A solid-state lighting device, comprising:

solid-state light emitters that emit light of different colors;

driver circuits that respectively drive the solid-state light emitters;

line sensing electronics that receives signal modulation on a power line to which the lighting device is connected to receive electrical power;

a digital controller that decodes the received signal modulation from the line sensing electronics into a digital command; and a memory device that stores the decoded digital command, wherein the digital controller retrieves the stored digital command to control the driver circuits based on the retrieved digital command to control at least one of color or optical power of the solid-state light emitters, wherein the digital controller is configured to, upon receiving a new digital command, control color or optical power of the light emitted by the one or more of the solid-state light emitters to momentarily change the emitted light to effectuate a visual signal indicating receipt of the digital command.

13. The device of claim 12, wherein the solid-state light emitters are semiconductor light-emitting diodes.

14. The device of claim 12, wherein the solid-state light emitters are semiconductor laser diodes.

15. The device of claim 12, wherein the momentary change in the emitted light includes a momentary change in the power of the emitted light to produce a blinking effect in the emitted light to effectuate the visual signal indicating receipt of the digital command.

16. The device of claim 12, wherein the momentary change in the emitted light includes a momentary change in the color of the emitted light to effectuate the visual signal indicating receipt of the digital command.

17. A method for controlling a solid-state lighting system, comprising:

coupling lighting devices in one or more power lines to provide electrical power to the lighting devices, each lighting device including solid-state light emitters that emit light of different colors, driver circuits that respectively drive the solid-state light emitters, line sensing electronics that receives signal modulation on the one or more power lines, a digital controller that decodes the received signal modulation from the line sensing electronics into a digital command, and a memory device that stores the decoded digital command, wherein the digital controller retrieves the stored digital command to control the driver circuits based on the retrieved digital command to control at least one of color or optical power of the solid-state light emitters;

coupling a control panel in the one or more power lines to which the lighting devices are connected;

operating the control panel to modulate the electrical power in the one or more power lines to send digital commands and respective ID addresses of respective lighting devices to the lighting devices via the one or more power lines; and operating a lighting device to respond to a respective digital command that is from the control panel and is targeted at the lighting device based on a respective ID address to control at least one of power or color of light output of the lighting device, wherein the method further comprises: operating each lighting device to, upon receiving a new digital command, momentarily change color or optical power of the light emitted by one or more of the solid-state light emitters in the lighting device to momentarily change the emitted light to effectuate a visual signal indicating receipt of the digital command by the lighting device.

18. The method of claim 17, wherein the momentary change in the emitted light includes a momentary change in the power of the emitted light to produce a blinking effect in the emitted light to effectuate the visual signal indicating receipt of the digital command.

19. The method of claim 17, wherein the momentary change in the emitted light includes a momentary change in the color of the emitted light to effectuate the visual signal indicating receipt of the digital command.

20. A solid-state lighting device, comprising:

solid-state light emitters that emit light of different colors;

a brightness enhancement layer positioned to receive output light from the solid-state light emitters and to select a portion of the received output light from the solid-state light emitters as output light in directions that are either perpendicular to, or at small angles with respect to the normal direction of, the brightness enhancement layer, wherein the device further comprises:

driver circuits that respectively drive the solid-state light emitters;

line sensing electronics that receives signal modulation on a power line to which the solid state lighting device is connected to receive electrical power;

a digital controller that decodes the received signal modulation from the line sensing electronics into a digital command; and a memory device that stores the decoded digital command, wherein the digital controller retrieves the stored digital command to control the driver circuits based on the retrieved digital command to control at least one of color or optical power of the solid-state light emitters, and wherein the digital controller is configured to, upon receiving a new digital command, control the color or optical power of the light emitted by the one or more of the solid-state light emitters to momentarily change the emitted light to effectuate a visual signal indicating receipt of the digital command.

21. The solid-state lighting system of claim 8, wherein the control panel is configured to include an identification (ID) address of the lighting device in the signal modulation, and wherein the digital controller in the lighting device is configured to recognize the ID address that is associated with the lighting device and to ignore a received digital command that has a different ID address.

22. The solid-state lighting system of claim 8, wherein the control panel is configured to include a human interface for a user to enter a command.

23. The solid-state lighting system of claim 8, wherein the digital controller adjusts a solid-state light emitter intensity by changing at least one of an amount of time the solid-state light emitter is turned on or a driving current that drives the solid-state light emitter.

24. The solid-state lighting system of claim 8, wherein the lighting device includes a light detection module that includes photo detectors operable to sense different wavelength spectrum of different solid-state light emitters in different separated color groups of the solid-state light emitters.

25. The solid-state lighting system of claim 8, further comprising: a light detection system that includes one photo detector operable to measure intensities of different solid-state light emitters in different separated color groups at a different time domain when the solid-state light emitters of other separated color groups are turned off.

* * * * *